US006473992B2

(12) United States Patent
Suzuki

(10) Patent No.: US 6,473,992 B2
(45) Date of Patent: Nov. 5, 2002

(54) 2-STEP METHOD FOR DRYING MASH-PRODUCTS

(75) Inventor: Takanobu Suzuki, Iwaki (JP)

(73) Assignee: Kiyoh Co., Ltd., Iwaki (JP)

( * ) Notice: Subject to any disclaimer, the term of this patent is extended or adjusted under 35 U.S.C. 154(b) by 0 days.

(21) Appl. No.: 09/559,649

(22) Filed: Apr. 28, 2000

(65) Prior Publication Data

US 2002/0017034 A1 Feb. 14, 2002

(30) Foreign Application Priority Data

Mar. 21, 2000 (KR) ..... 2000-142180

(51) Int. Cl.[7] ..... F26B 5/08

(52) U.S. Cl. ..... 34/318; 34/423; 34/425; 34/476; 34/482; 34/129; 34/128

(58) Field of Search ..... 34/423, 425, 476, 34/499, 482, 483, 486, 493, 108, 109, 127, 129, 130, 606, 318

(56) References Cited

U.S. PATENT DOCUMENTS 3,785,063 A * 1/1974 Bishop ..... 34/128
4,133,718 A * 1/1979 Jaquay ..... 201/6
4,177,575 A * 12/1979 Brooks ..... 34/13
4,296,072 A * 10/1981 Takacs et al. ..... 422/254
4,512,353 A * 4/1985 Brackman ..... 131/304

OTHER PUBLICATIONS

Suzuki; "A Floating Rotative Type of A Drying Method and Apparatus Thereof"; English Language Abstract of Korean Patent 130127; 2 pgs.

Suzuki; "The Process for Preparing Smoke–Dried Food"; English Language Abstract of Korean Patent 57619; 1 pg.

* cited by examiner

*Primary Examiner*—Ira S. Lazanus
*Assistant Examiner*—Mark S. Shulman
(74) *Attorney, Agent, or Firm*—Foley & Lardner

(57) ABSTRACT

The present invention relates to a method and device for drying mash-products, and more particularly to a 2-step device for drying mash-products comprising a first drying unit (a flow rotary drying unit) and a second drying unit (a mixing rotary drying unit), the first drying unit and the second drying unit being arranged in series, and a 2-step method for drying mash-products.

31 Claims, 4 Drawing Sheets

2-STEP METHOD FOR DRYING MASH-PRODUCTS

BACKGROUND OF THE INVENTION

1. Field of the Invention

The present invention relates to a method and device for drying mash-products, and more particularly, to a 2-step device for drying mash-products comprising a first drying unit (a flow rotary drying unit) and a second drying unit (a mixing rotary drying unit), the first drying unit and the second drying unit being arranged in series, and a 2-step method for drying mash-products.

2. Background of the Related Art

Fish cakes or dried mash-products are often used in food products manufactured in the shape of a circular plate, a semicircular plate, a swirl, a rice cake with a orange pattern imprinted, a designed crab, a panda and other animals as a kind of seasoning ingredient of instant noodles, such as curled noodles and noodles in a bowl. The term "mash-product" in this specification and claims can be defined as a product made from wheat flour dough and the like.

FIG. 4 is a schematic side cross-sectional view of a flow rotary drying device disclosed from Korean Patent No. 130127, which was published on Apr. 17, 1998 under Korean Patent Publication No. 130127/1998. The aforesaid patent discloses a method and device for drying mash-products in which cut mash-products 105 are sorted by a mesh-type vibrating input feeder, moved into an input opening 107 by means of an input fan, dropped into an inlet of a drying can 101 by means of a screening plate 103, and flowed and transferred to an output opening.

According to the aforesaid patent, however, if the speed of hot wind 104 in the vicinity of the inlet is increased in order to make the mash-products float and flow in the rotary drum, the mash-products are flown to the output opening earlier than a predetermined time, which results in mash-products with less than a desired predetermined moisture.

In addition, if the mash-products are provided with more reducing starchy resolution substance (for example, D-sorbitol, millet jelly, etc.) than typically used in the prior art so as to prevent split of the mash-products, the mash products tend to adhere to one another during the drying operation. In order to prevent this phenomenon, the mash-products must be floated and flowed heavily within the rotary drum, until the moisture content is sufficiently reduced. As the speed of the hot wind 104 increases in order to float and flow the mash-products heavily, the aforementioned phenomenon occurs more significantly, which can result in degraded mash-products.

SUMMARY OF THE INVENTION

Therefore, the present invention is aimed to solve the aforementioned problems.

An object of the present invention is to provide a 2-step method for drying mash-products, comprising the steps of: carrying out a first drying operation of mash-products until the mash-products have a moisture content of 25 to 35%, and throwing the semi-dried mash-products in the improved unit of the same type in order to carry out a second drying operation. The aforementioned method can increase the speed of the hot wind during the first drying operation, and finely adjust the moisture content to the predetermined value.

Another object of the present invention is to provide a 2-step device for drying mash-products which carries out the aforesaid method.

Still another object of the present invention is to provide a method for drying mash-products, wherein a plurality of teflon-coated metal nets, which are bent in the shape of mountains (i.e. corrugated), are arranged in the rotary drum during the second drying operation so that an inner surface area of the rotary drum is substantially increased. Further, hot wind is supplied at a low speed while the rotary drum is rotated at a rapid speed, thereby increasing the amount of contact between the mash-products and the hot wind, resulting in rapid drying of the mash-products.

Another object of the present invention is to provide a 2-step device for drying mash-products which carries out the aforesaid method.

Still other object of the present invention is to provide a method for drying mash-products, wherein the temperature of the hot wind or the angle of inclination of the drum is finely adjusted during the second drying operation. It is thereby possible to more finely and easily adjust the drying operation than in the prior art. The method further provides for adjusting the angle of inclination of the drum to a maximum after the drying operation, while the opening and closing unit of the output opening is fully opened, thereby drawing out the mash-products more rapidly and easily than in the prior art.

Another object of the present invention is to provide a 2-step device for drying mash-products which carries out the aforesaid method.

BRIEF DESCRIPTION OF THE DRAWINGS

The preferred embodiment of the present invention will be described in detail with reference to the accompanying drawings. In the drawings.

DESCRIPTION OF PREFERRED EMBODIMENTS OF THE INVENTION

The present invention will be described in further detail by way of example with reference to the accompanying drawings.

Figure 1:
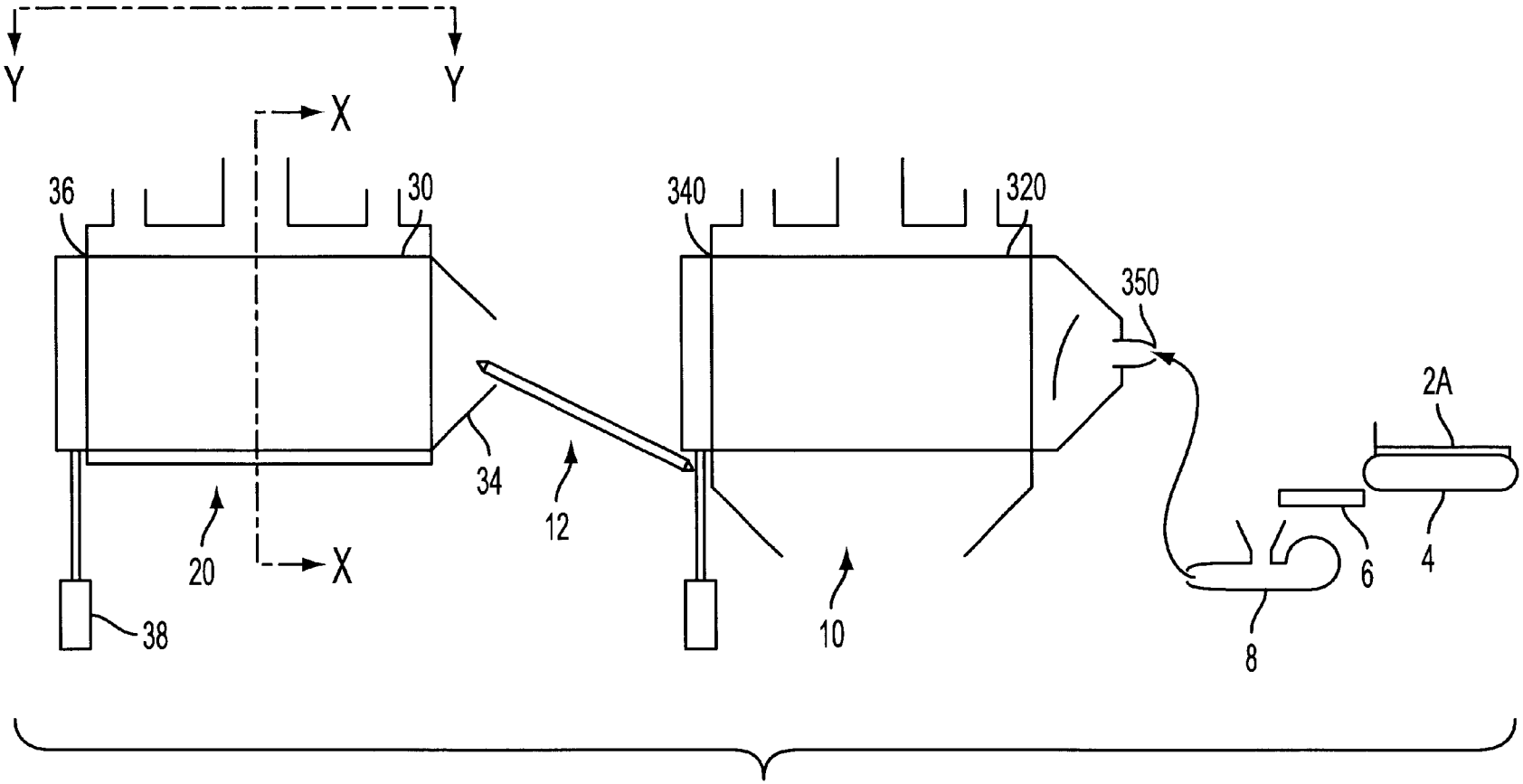
FIG. 1 is a schematic view showing a 2-step device for drying mash-products according to the present invention.

FIG. 1 is a schematic view showing a 2-step device for drying mash-products according to the present invention. Frozen mash-products 2A are cut to a predetermined thickness, for example 1.0 mm to 3.0 mm, by means of a cutting device 4. The cut mash-products 2A are transferred into a vibrating feeder 6 in the shape of nets, by which the mash-products are sorted and the poor mash-products are removed. The sorted good mash-products 2A are thrown into a first drying unit 10 by an air blast generated by means of an input fan 8. The mash-products 2B, which are dried in the first drying unit 10, are transferred into a second drying unit 20 by means of a input conveyor 12. The second drying operation is carried out in the second drying unit 20.

Figure 4:
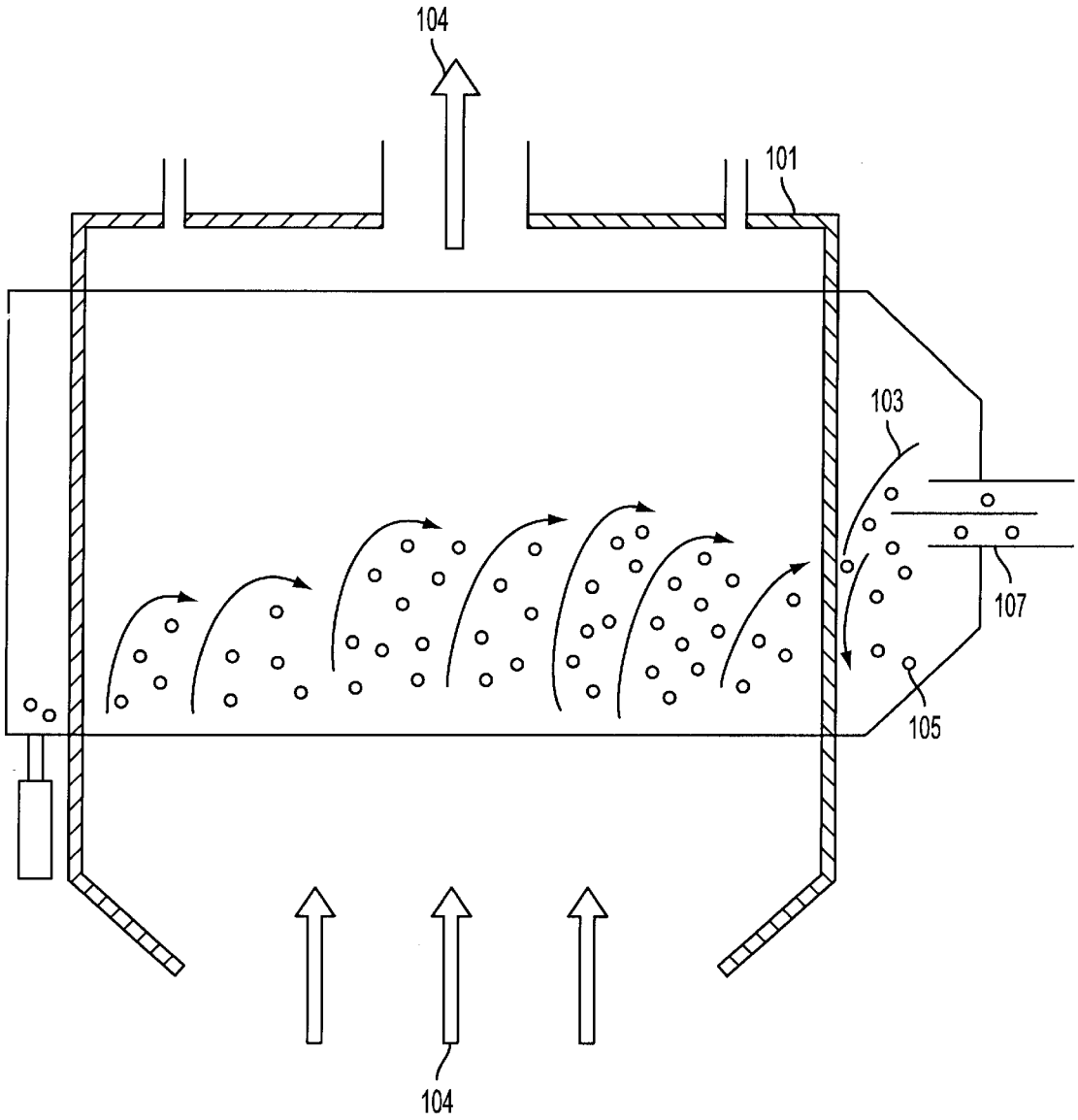
FIG. 4 (PRIOR ART)
FIG. 4 is a schematic side cross-sectional view of a flow rotary device for drying mash-products according to the prior art.

The first drying unit is a flow rotary drying unit in which a large quantity of hot wind is supplied into the even rotary drum 320 so as to float and flow the mash-products heavily, and to mix the hot wind and the mash-products. This process results in a substantially uniform drying of the mash-products. The drum 320 is rotated in order to prevent the mash-products from accumulating at a place where the hot wind is relatively weak. The first drying unit is identical or similar to the drying device of the aforesaid patent shown in FIG. 4, thus the detailed description of the construction thereof will be omitted.

During the first drying operation, the mash-products, which are cut to a thickness of 1 mm to 3 mm, are input at the rate of 3 to 6 kg/min, and the drum is rotated at 4 to 5 rpm. The mash-products are dried continuously for 10 minutes to 20 minutes while hot wind having a temperature of 50 to 70° C. is supplied to the inlet at the speed of 6 to 8 m/sec and to the outlet at the speed of 4 to 6 m/sec. As the flow rate of the hot wind is increased, the speed of the hot wind which passes over the surface of the mash-products is increased and the pressure on the mash-products is decreased. The increase of the hot wind speed across the surface of the mash products and reduced pressure on the mash products reduces the drying time of the surfaces of the mash-products, to prevent them from adhering to one another at a low hot wind temperature.

Figure 2:
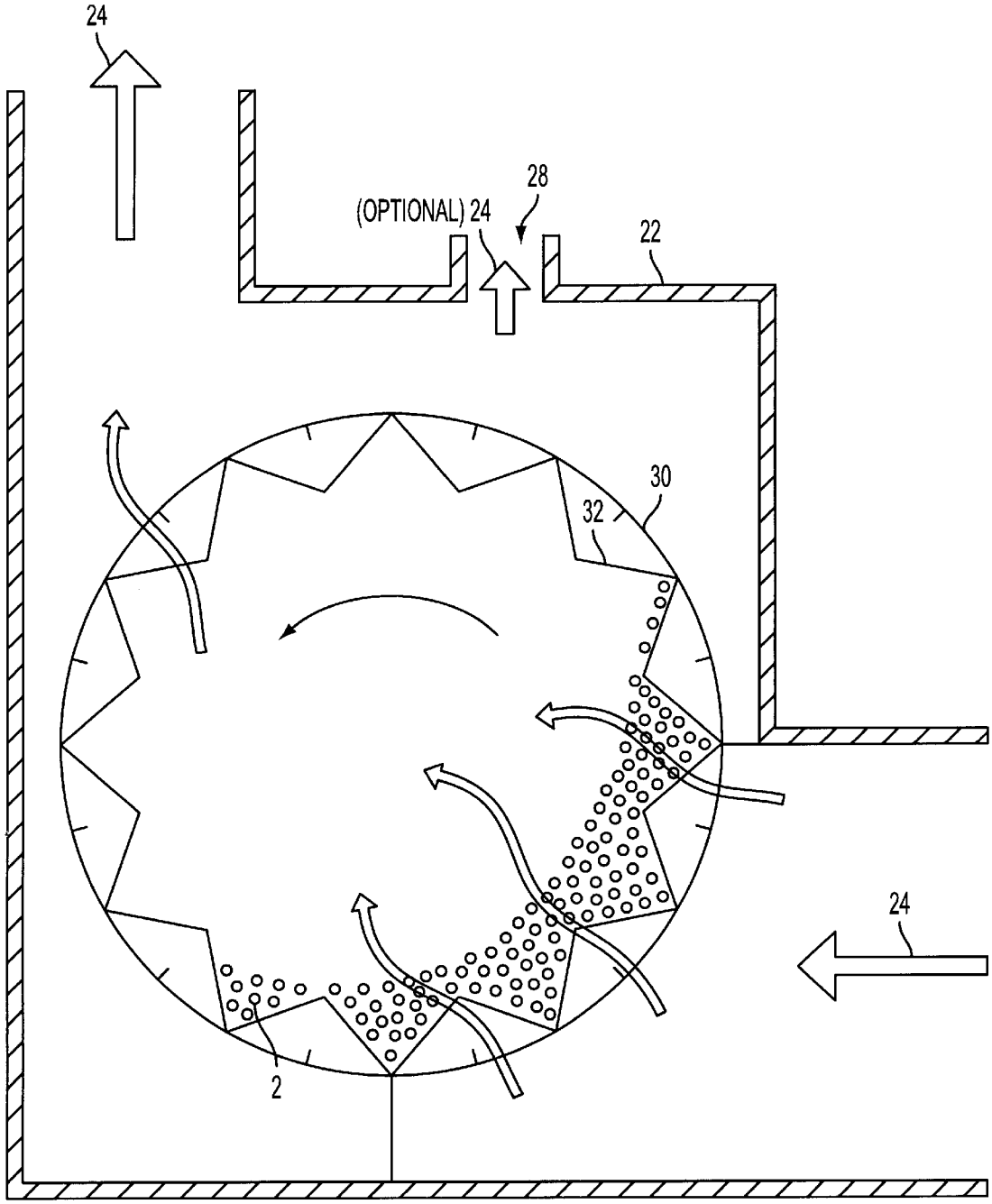
FIG. 2 is a schematic side cross-sectional view showing a second drying unit of the 2-step device for drying mash-products according to the present invention along a line X—X of FIG. 1.
Figure 3:
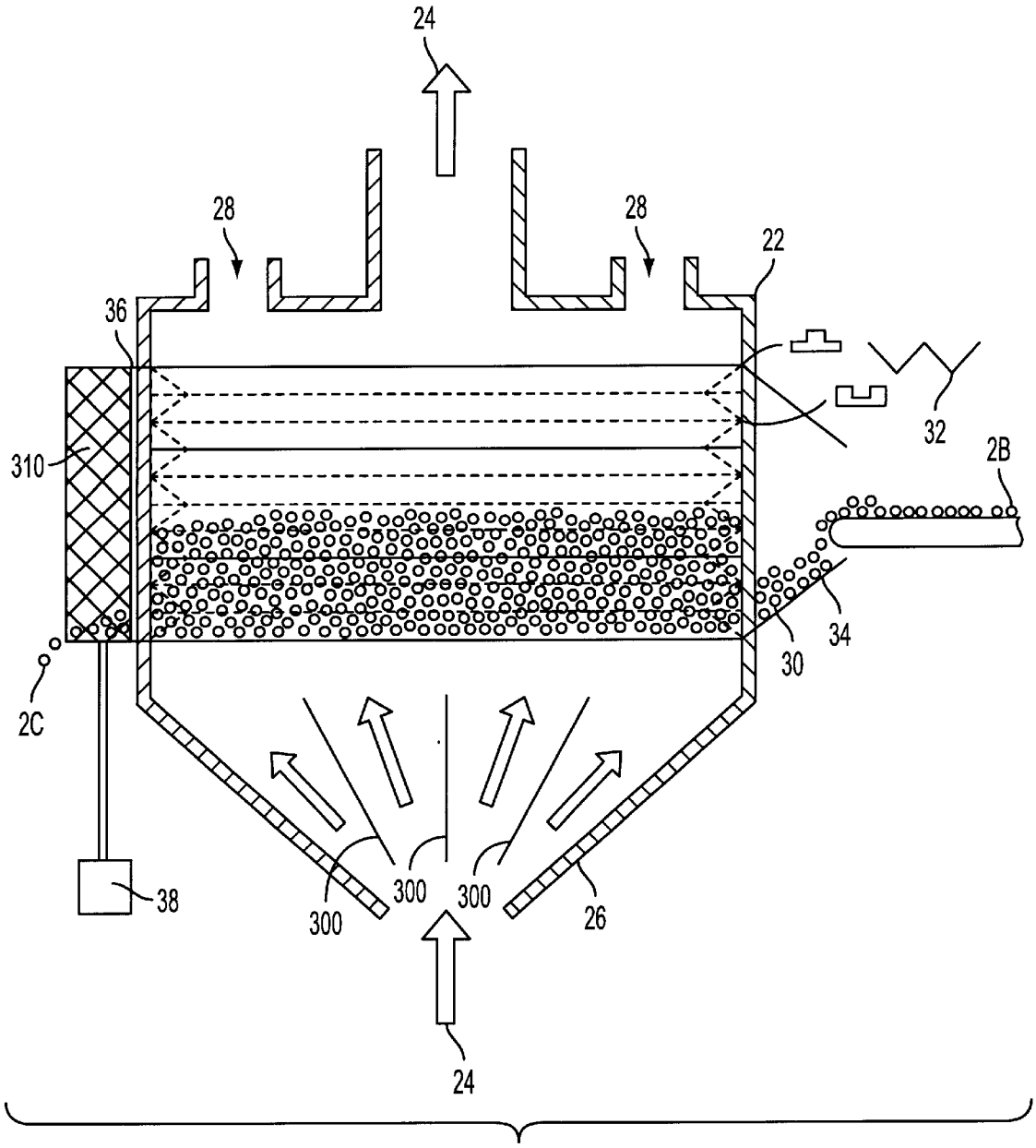
FIG. 3 is a front view showing a second drying unit of the 2-step device for drying mash-products according to the present invention along a plane Y—Y of FIG. 1.

FIG. 2 is a schematic side cross-sectional view along a line X—X of FIG. 1 showing a second drying unit 20 of the 2-step device for drying mash-products according to the present invention. FIG. 3 is a front cross-sectional view along a plane Y—Y of FIG. 1 of the second drying unit of FIG. 2. The second drying unit 20 is a mixing rotary drying unit. Hot wind is supplied into the rotary drum 30 with the uneven surface such that the mash-products are floated or flowed. As the drum is rotated, the mash-products in the depressed portions are lifted to the upper portion of the drum and then dropped, so that the mash-products are mixed with the hot wind during the drying operation. At this time, if the rotating speed of the drum 30 is increased, the mixing rate of the mash-products with the hot wind is increased, thereby improving mash-product drying uniformity.

Referring to FIG. 2 and FIG. 3, a drying can 22 of the second drying unit 20 is provided at the lower side portion thereof, with a input opening 26 through which hot wind 24 is input, and is provided at the upper portion thereof with an output opening 28 through which wasted hot wind is discharged. The drum 30 is provided at the part thereof located inside the drying can 22 with holes and a plurality of depressed portions 32 made of teflon-coated metal and formed in the shape of mountains (i.e. corrugated). The drum 30 is provided at one end thereof with an input opening 34, and is provided at the other end thereof with an output opening 36. Two or more dampers 300 are provided for adjusting the flow rate of hot wind 24, and a plunger 38 is provided for adjusting the angle of inclination of the drum 30.

During the second drying operation, the input conveyor 12, the blowing fan (not shown), the discharging fan (not shown), and the drum are rotated. The hot wind which is heated to the temperature of 70 to 120° C., preferably 100° C. by means of a burner, is supplied to the input opening 34 and the output opening 36 at the wind speed of 1 to 3 m/sec, preferably 2 m/sec. The drum 30 is rotated at 6 to 8 rpm, preferably 12 rpm. The input conveyor 12 is operated while the drum 30 is maintained horizontally. The mash-products 2B, which are dried to 25 to 35% moisture content by the first dry operation, are output at the rate of 2 to 4 kg/min, and subsequently transferred into the second drying can 22. After 20 to 40 minutes, preferably 25 minutes from the beginning of the inputting operation, the dried mash-products 2C are drawn out by proper opening of the opening and closing unit 310 of the output opening 36.

At this time, some of the dried mash-products 2 may have accumulated in the depressed portions in the mixing rotary drying unit (the second drying unit). Thus, not all of the mash-products are necessarily subjected to the hot wind uniformly. For this reason, the mash-products may be bent if they are not dried evenly. Accordingly, in order to dry the mash-products evenly, the mash-products must be dried in the flow rotary drying unit (the first drying unit) until they contain a moisture content (25 to 35%) with which they may not be bent by the mixing rotary drying unit, and then the mash-products must be finely adjusted in the mixing rotary drying unit (the second drying unit) until they contain the desired moisture. Even if the moisture content in the mash-products inputted into the mixing rotary drying unit is not uniform, since the amount of the supplied hot wind is less, the mash-products with a higher moisture content can take the heat capacity necessary for vaporizing the moisture to be dried relatively fast. Similarly, mash-products containing a lower moisture content are not subjected to the heat capacity necessary for vaporizing the moisture, and can be dried relatively slow (referring to drying device, TOUEI RYOZO, nikkan kogyo shinbunsha, Feb. 10, 1980, pages 12–13). As a result, the mash-products are dried uniformly at the output opening.

The fine adjusting in the second drying operation will now be described. The temperature of the hot wind or the angle of inclination of the drum 30 is adjusted, thereby carrying out the adjusting operation more finely and easily than in the prior art. In addition, the angle of inclination of the drum 30 is adjusted to a maximum after the drying operation, and at the same time the opening-closing unit of the output opening is fully opened, thereby drawing out the mash-products more rapidly and easily than in the prior art.

According to one aspect of the present invention, the 2-step method for drying the mash-products comprises the steps of: carrying out a first drying operation of the mash-products 2A; and carrying out a second drying operation of the mash-products 2B which has been dried by the first drying operation.

According to another aspect of the present invention, the second drying operation comprises the steps of: rotating the drum 30; blowing hot wind into the drum 30; throwing the first dried mash-products 2B into the input opening 34 by means of an input conveyor 12; dropping the input mash-products 2B into the inlet so that they are dried secondly in the rotating drum 30; and discharging the second dried mash-products 2C through the discharging opening 36, wherein the hot wind used for drying is circulated during the second drying operation, and at the same time the used hot wind is discharged.

EXAMPLE

According to one preferred embodiment of the present invention, a reducing starchy resolution substance (for example, D-sorbitol, millet jelly, etc.) was added to the mash-products, the amount of which was two times that of the aforesaid patent. Frozen mash-products 2A formed by a prescribed process were cut to 1.0 mm in thickness, and then transferred into the first drying unit via the input fan 8, at the rate of 6 kg/min. In the first drying unit 10, hot wind 24 having a temperature of 70° C. was supplied to the input opening 350 at a speed of 7.5 m/sec and to the output opening 36 at a speed of 5.5 m/sec. The rotating speed of the drum 320 was 4 rpm. The blown mash-products 2A were floated and flowed, and then were moved to the output opening 340 slowly. As the mash-products were moved to the output, the rate of float and flow was reduced. Under this condition, the drum 320 was inclined while the output opening 340 was opened so that the mash-products 2B was discharged by 4 kg/min after 15 minutes. The moisture content of the continuously discharged mash-products 2B was 25.7%.

Subsequently, the mash-products were transferred into the second drying unit 20, in which the temperature of the hot wind was set to 110° C., and the speed of the hot wind was set to approximately 1.0 m/sec both for the input opening and the output opening. The mash-products were blown into the uneven drum 30 rotating at 9 rpm by means of the input conveyor 12. The blown semi-dried mash-products 2B were mixed with the hot wind 24, and transferred to the output opening 36 slowly.

Under this condition, the drum 30 was inclined while the output opening 36 was opened so that the mash-products 2B were discharged by 3.3 kg/min after 20 minutes. The moisture content of the continuously discharged mash-products 2B was 11.5%.

According to the method and device for drying the mash-products of the invention, the mash-products are input continuously during the first drying operation, floated and flowed heavily, dried with the condition that they are flat, have the desired moisture content without bending or adhesion, and output successively. Afterwards, the mash-products are transferred to the second drying operation. In the second drying operation, since the inner surface area of the drum is large and the drum is rotated very fast, the mash-products are mixed satisfactorily with the hot wind. Further, since the hot wind is supplied at a low speed, the mash-products are not flown away toward the output opening, and thus it is possible to more finely and easily adjust the moisture content of the mash-products than in the prior art. Consequently, it is possible to maintain the mash-products under the optimal dried condition without requiring skilled operators. In addition, during the second drying operation, since the used hot wind is circulated and then reused, it is possible to save on energy. Also, since the angle of inclination of the plunger can be adjusted after the drying operation, the dried mash-products can be discharged more easily than in the prior art.

What is claimed is:

1. A method for drying mash-products in a system including a first drying unit, a second drying unit, and a conveyor, the first drying unit comprised of a first rotatable drum and the second drying unit comprised of a second rotatable drum, the method comprising the steps of:

performing a first drying operation in said first drying unit, said first drying operation comprised of the steps of:

blowing cut mash-products into said rotatable drum;

rotating said first rotatable drum;

blowing hot wind into said first rotatable drum; and discharging first dried mash-products from said first rotatable drum; and performing a second drying operation in said second drying unit, said second drying operation comprised of the steps of:

rotating said second rotatable drum;

blowing hot wind into said second rotatable drum, said hot wind simultaneously being circulated within said second rotatable drum and being discharged out of said second rotatable drum;

throwing said first dried mash-products into an input opening of said second rotatable drum via said input conveyor;

dropping said first dried mash-products down said input opening; and discharging second dried mash-products through a discharging opening.

2. The method according to claim 1, wherein three dampers are arranged at said input opening, a middle portion thereof, and said output opening such that the flow rate of the hot wind is adjusted equally at each position when the hot wind is blow during the second drying operation.

3. The method according to claim 1, wherein said first rotatable drum is rotated at 3 to 6 rpm, and said second rotatable drum is rotated at 6 to 18 rpm.

4. The method according to claim 1, wherein the temperature of the hot wind is 50 to 70° C. during the first drying operation, and the temperature of the hot wind is 70 to 120° C. during the second drying operation.

5. The method according to claim 1, wherein the speed of the hot wind is 6 to 8 m/sec at an inlet thereof and 4 to 6 m/sec at an outlet thereof during the first drying operation, and the speed of the hot wind is 1 to 3 m/sec during the second drying operation.

6. The method according to claim 1, wherein the drying time of the first drying operation is 10 to 20 minutes, and the drying time of the second drying operation is 20 to 40 minutes.

7. The method according to claim 1, wherein the moisture content of the mash-products blow into said first rotatable drum is 45 to 60%, and the moisture content of the mash-products dropped down said input opening is 25 to 35%.

8. The method according to claim 1, further comprising an opening and closing unit at said discharging opening for adjusting the amount of the discharged mash-products to control the moisture content before discharging dried-mash products through said discharging opening.

9. The method according to claim 1, further comprising adjusting the moisture content of the discharged mash-products by controlling the temperature of the hot wind.

10. The method according to claim 1, further comprising adjusting the moisture content of the discharged mash-products by controlling an inclination angle of said second rotatable drum.

11. A mash-product drying apparatus, comprising:

a first drying unit comprised of:

an inlet for receiving mash-product; and an outlet for outputting mash-product dried to a first moisture content; and a second drying unit comprised of:

an inlet coupled to said first drying unit, said inlet receiving said mash-product at a first moisture content;

a rotating drum including a corrugated portion on an internal surface; and an outlet for outputting mash-product dried to a second moisture content, said second moisture content being lower than said first moisture content, wherein said corrugated portion serves to throw mash-product drying in said rotating drum.

12. The mash-product drying apparatus of claim 11, wherein said second drying unit further comprises a hot wind inlet for blowing hot wind into said second drying unit, said hot wind drying mash-product in said rotating drum.

13. The mash-product drying apparatus of claim 12, wherein said hot wind has a temperature in the range of about 70° C. to about 120° C.

14. The mash-product drying apparatus of claim 12, wherein said hot wind is blown into said hot wind inlet at a velocity in the range of about 1 m/sec to about 3 m/sec.

15. The mash-product drying apparatus of claim 12, wherein said second drying unit further comprises:

a first damper arranged at said inlet coupled to said first drying unit;

a second damper arranged in a middle region of said corrugated portion; and a third damper arranged at said outlet, wherein said first damper, said second damper, and said third damper provide a substantially uniform hot wind flow rate within said second drying unit.

16. The mash-product drying apparatus of claim 11, wherein said second drying unit further comprises a plunger for controlling an angle of inclination of said rotating drum.

17. The mash-product drying apparatus of claim 11, wherein said second drying unit further comprises an opening and closing unit coupled to said outlet, said opening and closing unit controlling the moisture content of mash-product outputted via said outlet by adjusting the amount of outputted mash-product via said outlet.

18. The mash-product drying apparatus of claim 11, wherein said first moisture content is in the range of about 25% to about 35%.

19. The mash-product drying apparatus of claim 11, wherein said rotating drum is rotated at a rate in the range of about 6 rpm to about 18 rpm.

20. A method of drying mash-products, comprising:

drying mash-products to a first moisture content in a first drying unit; and drying said mash-products at a first moisture content in a second drying unit including:

rotating said mash-products at a first moisture content;

throwing said rotating mash-products; and discharging mash-products dried to a second moisture content lower than said first moisture content.

21. The method of claim 20, wherein drying said mash-products in a second drying unit further comprises blowing hot wind while rotating said mash-products, said hot wind drying said mash-products in said second drying unit.

22. The method of claim 20, wherein said hot wind has a temperature in the range of about 70° C. to about 120° C.

23. The method of claim 21, wherein said hot wind is blown at a velocity in the range of about 1 m/sec to about 3 m/sec.

24. The method of claim 21, further comprising simultaneously circulating said hot wind within said second drying unit and discharging used hot wind from said second drying unit.

25. The method of claim 20, wherein drying said mash-products in a second drying unit further comprises changing an inclination angle of said second drying unit.

26. The method of claim 20, wherein drying said mash-products in a second drying unit further comprises changing a discharge rate of said discharging step to control the moisture content of mash-product discharged in said discharging step.

27. The method of claim 20, wherein said first moisture content is in the range of about 25% to about 35.

28. The method of claim 20, wherein said rotating is performed at a rate of about 6 rpm to about 18 rpm.

29. A multi-stage air food drying device, comprising:

a first rotary drying device, comprised of:

a food intake for receiving food having a pre-drying moisture content;

a rotatable drum section having a substantially smooth internal volume;

a hot air intake for receiving hot air at a first velocity and a first temperature, said hot air drying said food having a pre-drying moisture content within said rotatable drum section; and an outlet for discharging food dried to a first dried moisture content; and a second rotary drying device, comprised of:

a dried food intake for receiving said food dried to a first dried moisture content;

a rotatable drum section having a corrugated internal volume;

a plunger for changing an inclination angle of said rotatable drum section;

a hot air intake for receiving hot air at a second velocity and a second temperature, said hot air drying said food dried to a first dried moisture content within said rotatable drum section;

a plurality of dampers disposed within said second rotary drying device which adjust a flow rate of said hot air within said second rotary drying device; and an outlet for discharging food dried to a second dried moisture content lower than said first dried moisture content.

30. The multi-stage air food drying device of claim 29, wherein said first temperature is in the range of about 50° C. to about 70° C., and wherein said first velocity is in the range of about 6 m/sec to about 8 m/sec.

31. The multi-stage air food drying device of claim 29, wherein said second temperature is in the range of about 70° C. to about 120° C., and wherein said second velocity is in the range of about 4 m/sec to about 6 m/sec.

* * * * *

UNITED STATES PATENT AND TRADEMARK OFFICE

CERTIFICATE OF CORRECTION

PATENT NO. : 6,473,992 B2
DATED : November 5, 2002
INVENTOR(S) : Takanobu Suzuki It is certified that error appears in the above-identified patent and that said Letters Patent is hereby corrected as shown below:

Title page, Item [54] and Column 1, lines 1 and 2,
Change Title of Invention from "2-STEP METHOD FOR DRYING MASH-PRODUCTS" to -- 2-STEP METHOD FOR DRYING MASH-PRODUCTS AND DEVICE THEREOF --.

Title page,
Item [73], change the spelling of the name of the Assignee from "Kiyoh Co., Ltd." to -- Eiyoh Co., Ltd. --.
Item [30], delete the added zero "0" at the end of the Foreign Application Priority Data.

Signed and Sealed this

Twenty-ninth Day of July, 2003

JAMES E. ROGAN
*Director of the United States Patent and Trademark Office*